US009902534B2

(12) United States Patent
Erlhöfer

(10) Patent No.: US 9,902,534 B2
(45) Date of Patent: Feb. 27, 2018

(54) DROPPER

(71) Applicant: Louvrette GmbH design & packaging, Kierspe (DE)

(72) Inventor: Gerd Erlhöfer, Kierspe (DE)

(73) Assignee: LOUVRETTE GMBH DESIGN & PACKAGING, Kierspe (DE)

( * ) Notice: Subject to any disclaimer, the term of this patent is extended or adjusted under 35 U.S.C. 154(b) by 37 days.

(21) Appl. No.: 15/046,681

(22) Filed: Feb. 18, 2016

(65) Prior Publication Data

US 2016/0236834 A1 Aug. 18, 2016

(30) Foreign Application Priority Data

Feb. 18, 2015 (DE) ..... 10 2015 102 273

(51) Int. Cl.
*B65D 47/18* (2006.01)
*B65D 47/12* (2006.01)
*B65D 8/00* (2006.01)

(52) U.S. Cl.
CPC ..... *B65D 47/18* (2013.01); *B65D 11/04* (2013.01); *B65D 47/128* (2013.01); *B65D 2547/066* (2013.01)

(58) Field of Classification Search
CPC ..... B65D 47/18; B65D 47/128; B65D 11/04; B65D 2547/066; B65D 47/06
See application file for complete search history.

(56) References Cited

U.S. PATENT DOCUMENTS 2,684,789 A 7/1954 Marchant
2,734,665 A * 2/1956 Flamm ..... B65D 47/18 222/207
3,107,035 A * 10/1963 Cholet ..... B65D 47/18 222/213
3,552,605 A 1/1971 Hein
5,487,495 A * 1/1996 Derksen ..... B65D 47/18 222/209
5,578,020 A * 11/1996 Mosley ..... A61F 9/0026 604/295
5,975,381 A * 11/1999 Revenu ..... B29C 45/1635 215/307

(Continued)

FOREIGN PATENT DOCUMENTS

DE 3028079 A1 4/1981
EP 0254810 A2 2/1988

*Primary Examiner* — Frederick C Nicolas
(74) *Attorney, Agent, or Firm* — Lucas & Mercanti, LLP; Klaus P. Stoffel

(57) ABSTRACT

A device for dispensing drops with a cap that forms a nozzle, wherein the nozzle features a wall, which is attached to a large-diameter end section and in certain areas realized in the form of an annular neck, as well as a small-diameter end section, which is attached to the annular neck and features an opening, and wherein an axis of the nozzle extends through the opening and the large-diameter end section. The wall of the annular neck is so flexible that the axis of the nozzle is tilted by an angle and a concavity is formed in the region of the annular neck when a force is exerted upon the small-diameter end section. An actuating projection for exerting the force is assigned to the small-diameter end section and protrudes transverse to the nozzle axis, wherein the actuating projection is formed by a collar with a circular horizontal projection.

14 Claims, 10 Drawing Sheets

(56) References Cited

U.S. PATENT DOCUMENTS

| | | | | |
|---|---|---|---|---|
| 8,608,001 | B2 * | 12/2013 | Stoneberg | B65D 47/0819<br>215/235 |
| 2002/0079338 | A1 * | 6/2002 | Pardo | B65D 47/18<br>222/422 |
| 2005/0184104 | A1 * | 8/2005 | Mutterle | B65D 47/18<br>222/420 |
| 2008/0209857 | A1 * | 9/2008 | Morini | B65B 55/04<br>53/281 |
| 2011/0163114 | A1 | 7/2011 | Webb | |

* cited by examiner

DROPPER

The present application claims priority of DE 10 2015 102 273.7, filed Feb. 18, 2015, the priority of this application is hereby claimed and this application is incorporated herein by reference.

BACKGROUND OF THE INVENTION

The invention pertains to a device for dispensing drops with a cap that forms a nozzle, wherein the nozzle features a wall, which is attached to a large-diameter end section and in certain areas realized in the form of an annular neck, as well as a small-diameter end section, which is attached to the annular neck and features an opening, and wherein an axis of the nozzle extends through the opening and the large-diameter end section.

Drop dispensers are known, for example, from U.S. Pat. No. 2,684,789. A cap for sealing a storage receptacle features a nozzle with a sealing collar that is assigned to a large-diameter section of the nozzle. The diameter of the nozzle decreases in the direction of a nozzle axis such that an annular neck with a concave outer wall is formed. The outer wall transforms into a small-diameter end section that contains an outlet opening for a liquid or pasty mass stored in the receptacle. When pressure is exerted upon the lateral surfaces of the receptacle, its volume is reduced and a portion of the liquid stored in the receptacle is pushed through the outlet opening. A drop dispenser with similar design and function is described in DE 30 28 079 A1.

SUMMARY OF THE INVENTION

The invention is based on the objective of advantageously enhancing an initially cited device. This objective is attained with the invention disclosed in the claims, wherein the dependent claims not only represent advantageous enhancements of the master claim, but also independent solutions of the above-defined objective.

It is initially and essentially proposed that the wall of the annular neck is flexible. A force exerted upon the nozzle transverse to the direction of its axis respectively leads to a tilt of the nozzle or its axis extending through the nozzle opening. A concavity is formed in the region of the annular neck on the side, toward which the nozzle is tilted. The wall of the annular neck arches into the inner volume of the cap. This leads to a reduction of the inner volume of the cap enclosed by the nozzle wall. The cap is preferably seated on an opening of a cup part that forms a storage receptacle for a liquid or pasty mass. The receptacle is therefore annularly enclosed. The liquid or pasty mass in the receptacle can only escape through the nozzle opening. If the drop dispenser is turned upside down prior to tilting the small-diameter end section such that the inner volume of the cap is filled with the liquid or pasty mass, a portion of the pasty mass or the liquid escapes from the outlet opening as a result of the volume reduction caused by the tilting and arching. The flexible wall of the annular neck has a sufficient restoring force for once again returning the nozzle into its original position after the transverse force has been suspended. This leads to a slight suction effect such that the portion of the liquid or pasty mass located in the small-diameter end section is once again drawn into the receptacle. The nozzle is preferably made of a soft plastic, preferably of polypropylene. It features sections with different wall thicknesses. The two end sections preferably have a greater wall thickness than the section of the nozzle forming the annular neck.

The annular neck may feature several sections that are arranged successively in the axial direction. It is proposed, in particular, that a sharply curved annular neck section is directly attached to an edge of the nozzle that has the greatest diameter. A slightly curved annular neck section follows this sharply curved annular neck section and transforms into the essentially cylindrical end section. An actuating zone or an actuating section is preferably assigned to this end section, This actuating zone can be haptically distinguished from the adjacent zones. It may consist of a cylindrical zone. The surface of the nozzle may be roughened in this zone. It may also feature nubs that protrude radially outward. An actuating projection, which transversely protrudes radially outward—referred to the nozzle axis—is preferably assigned to said end section. This actuating projection forms a haptic resistance, against which a force can be exerted with the finger of a user. This force may have an axial component and a radial component that is directed toward the axis in order to tilt the small-diameter end section of the nozzle relative to the large-diameter end section of the nozzle and to thereby form the aforementioned concavity. However, it basically suffices to exert an axial force upon the actuating projection. Since the actuating projection is spaced apart from the axis, a torque is generated and causes the nozzle section on the opening side to be tilted. The actuating projection may extend over the entire circumference of the rotationally symmetrical end section. To this end, the projection may be formed by a collar that radially protrudes from the outer wall of the end section. However, it would also be possible that several individual projections protrude from the nozzle in different directions. For example, four identical projections, which are arranged in uniform circumferential distribution around the nozzle axis, may protrude radially outward from the nozzle. Each projection may feature a fingertip contact surface. The fingertip contact surface may be formed by the slightly curved region of the nozzle and realized in the form of a rounding. A flank section of the actuating projection lying opposite of the fingertip contact surface may lie in a plane. This plane may consist of a plane extending transverse to the nozzle axis. However, the actuating projection or the multiple actuating projections may in a horizontal projection also extend along a circular arc analogous to the horizontal projection of the collar. The nozzle is preferably realized in the form of a body of revolution. The wall of the curvature preferably extends continuously along a convex line of curvature between the large-diameter end section and the small-diameter end section such that the inner wall of the nozzle has the shape of a funnel. The nozzle is made of a soft plastic, particularly of polypropylene, and has the smallest wall thickness in the region of the annular neck. An outlet opening with smaller diameter may be provided in the region of the opening of the small-diameter end section. The outlet opening is preferably enclosed by an edge and spaced apart from the opening of the small-diameter end section in the axial direction. The diameter of the outlet opening can therefore be adapted to the viscosity of the mass stored in the receptacle. The outlet opening has a small diameter for metering a liquid with low viscosity. However, the outlet opening has a large diameter for metering a pasty mass with high viscosity. The diameter of the outlet opening can be expanded as far as the diameter of the tubular small-diameter end section without having to otherwise modify the structural shape of the nozzle. The large-diameter end section of the nozzle is preferably connected to a mounting collar. The mounting collar is preferably made of a hard plastic, for example of polypropylene. The cap is preferably manufactured in a 2K injection-molding process, in which the mounting collar is initially produced and the nozzle is injected into the opening of the mounting collar. The mounting collar then lies in an annular groove of the nozzle that protrudes radially outward such that the nozzle protrudes over the mounting collar on both sides in the axial direction of the nozzle axis. The mounting collar serves for mounting the cap on a preferably cup-shaped receptacle such that an edge of the receptacle is sealed with the cap. In this case, a section of the nozzle fulfills a sealing function in that it adjoins the inner wall of the receptacle edge in a sealing fashion. The mounting collar preferably features snap-on means such as, for example, an annular projection that engages behind a corresponding mating bead of the receptacle edge when the cap is attached onto the receptacle. It would also be conceivable to provide means for producing a non-rotatable connection between the cap and the receptacle. This anti-rotation safety preferably comprises form-fitting means that engage with one another. For example, the edge of the receptacle may feature multiple tooth-like projections over its entire circumference, wherein openings for a corresponding anti-rotation projection of the mounting collar remain between said projections. It is furthermore proposed that the cap can preferably be sealed with a cover. The cover preferably features a circumferential wall with an opening edge that can be attached onto the large-diameter end section of the nozzle. It would be conceivable to provide a thread with a threaded rib that cooperates with a threaded section of the mounting collar such that the cover can be screwed on the mounting collar. In the sealed state, the cap protrudes into the cavity of the cover, the bottom of which preferably features sealing means that seal the opening of the small-diameter end section when the cover is attached onto the cap. The sealing means may feature a central sealing projection that protrudes into the opening of the small-diameter end section in the sealed state. The tubular small-diameter end section protrudes into an annular groove of the cover and is enclosed by an annular projection. The small-diameter end section may feature a sealing bead. This sealing bead may be arranged within the opening, i.e. directed radially inward. In this case, it adjoins the central sealing projection. If viewed in a cross section, the sealing bead preferably is in point contact with the sealing projection. In this way, a linear seal is formed around the sealing projection. The cover is preferably realized in such a way that it can only be attached in a straight direction in order to prevent the nozzle from bending when the cover is attached. However, the sealing bead may also point radially outward in order to adjoin the inner wall of the annular projection. The latter may feature a funnel-shaped opening in order to simplify the sliding insertion of the end section. The annular neck features sections with different curvatures. A sharply curved annular neck section, the contour line of which extends, for example, along a circular arc with a small radius, is directly attached to the edge of the large-diameter end section. A slightly curved annular neck section follows this sharply curved annular neck section and borders on the actuating projection. The contour line of this annular neck section also extends along a circular arc. However, this circular arc has a different radius.

The inventive device is filled in a state of assembly, in which the cap is inserted into the cover and the mounting collar of the nozzle is not yet connected to the receptacle. The receptacle can be filled through the large-diameter opening of the receptacle. The nozzle inserted into the cover is not attached onto the edge of the receptacle until the receptacle has been filled. The anti-rotation projections engage into the corresponding anti-rotation recesses and the snap-on projection engages behind the corresponding mating projection such that the cap is connected to the receptacle in a non-rotatable and tension-proof fashion. A ninety degree turn makes it possible to move the cover into a release position relative to the cap and to remove the cover in the axial direction.

Exemplary embodiments of the invention are described below with reference to the attached drawings. In these drawings:

DETAILED DESCRIPTION OF THE INVENTION

Figure 1:
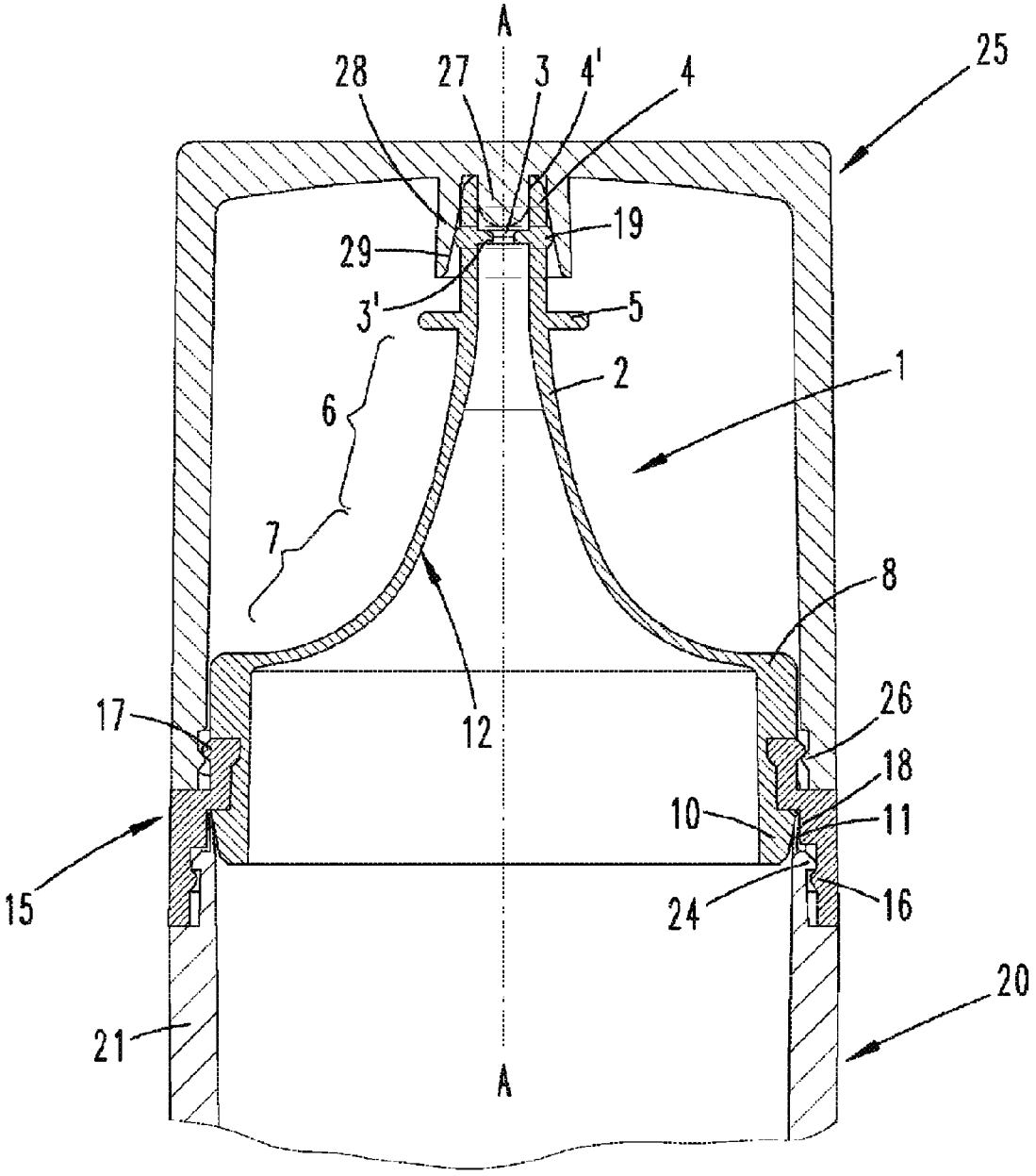
FIG. 1 shows a section of the drop dispenser on the cap side in the form of a section along the line I-I in FIG. 2.
Figure 2:
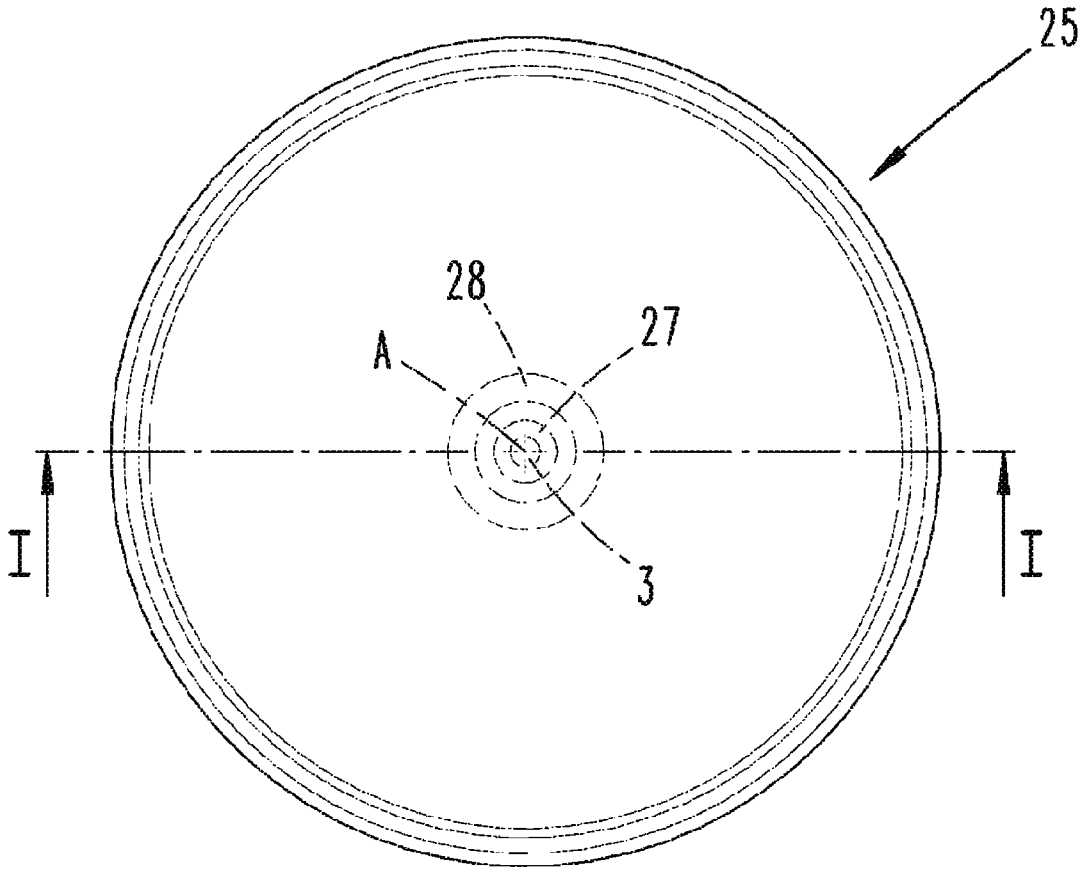
FIG. 2 shows a top view of the drop dispenser.
Figure 3:
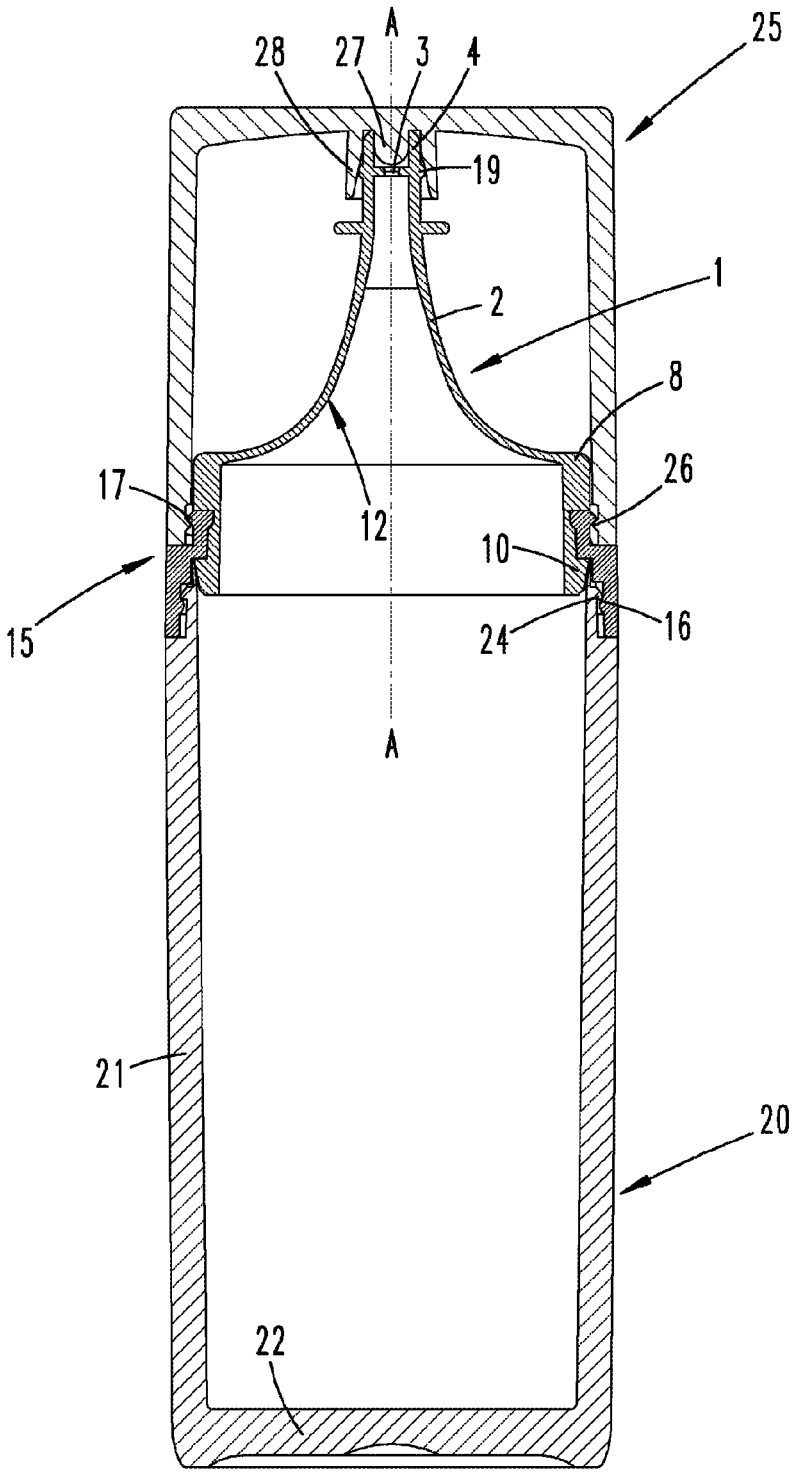
FIG. 3 shows a section analogous to FIG. 1, however, with complete enclosure.

FIG. 3 shows the essential elements of an inventive drop dispenser, namely a cup part 20 forming a receptacle with a plane bottom 22, which has the shape of a circular disk, and with a sidewall 21, which has the shape of a circular cylinder and features an upper opening edge, onto which a mounting collar 15 of a nozzle 2 is attached, wherein said nozzle forms part of a cap 1, onto which a cover 25 is attached, FIG. 1 shows an enlarged illustration of the upper section of FIG. 3, in which a mating projection 24 protrudes from the edge of the cup part 20 and a snap-on projection 16 of the mounting collar 15 engages behind said mating projection. The mounting collar 15 has a Z-shaped cross section and is altogether realized in the form of a ring. The snap-on projection 16 is directed radially inward whereas a threaded rib 17 is directed radially outward. The snap-on projection 16 and the mating projection 24 may be realized in the form of a circumferential rib.

The threaded rib 17 cooperates with a threaded rib 26 of the cover 25 that is directed radially inward. The threaded rib 17 and the corresponding threaded rib 26 have such a length that a ninety degree turn suffices for disengaging the threads 17, 26.

The mounting collar 15 consists of a plastic part that is made of a harder polypropylene and forms part of a 2K injection-molded part 1. This concerns a cap 1 that forms a nozzle 2. The nozzle 2 consists of a soft and elastic plastic, particularly of polypropylene, and forms a first cylindrical end section 10. The end section 10 forms a circumferential recess that is directed radially outward and into which the mounting collar 15 penetrates. The section of the nozzle 2 overlapping the mounting collar 15 forms a sealing flank 11. The sealing flank 11 is formed by a section of the nozzle wall that is directed radially outward and forms an annular gap together with a wall section of the mounting collar 15 that is directed radially inward, wherein an outermost section of the edge of the cover part 20 is inserted into said annular gap such that the sealing flank 11 is supported on the inner wall of the edge of the cup part 20 in a sealing fashion. However, it is also proposed to utilize other sealing configurations.

The large-diameter end section 10 has an outside diameter of 25-35 mm and borders on a first, sharply curved annular neck section 7. The sharply curved annular neck section 7 forms a wall section of the nozzle 2 that extends along a circular arc, which may have a radius of approximately 10 mm, in a longitudinal section through a nozzle axis A. The slightly curved section, the wall of which extends along a circular arc with a radius of approximately 45 mm, follows the sharply curved section 7. The two curved sections 6, 7 form an annular neck section that extends rotationally symmetrical to the nozzle axis A, wherein the nozzle axis A extends through the center of the large-diameter end section 10 and the center of the small-diameter end section 4 of the nozzle 2, to which the slightly curved section 6 is attached. The wall thicknesses of the two end sections 4, 10 are greater than the wall thicknesses of the curved sections 6, 7.

The axial length of the nozzle 2 approximately corresponds to the diameter of the large-diameter end section 10. The diameter of the small-diameter end section 4 amounts to approximately 5 mm. An actuating projection in the form of a collar 5 or annular projection is located in the region of the transition zone between the cylindrical small-diameter end section 4 and the slightly curved section 6. The annular projection protrudes over the outer wall of the nozzle 2 by approximately 3-5 mm and, if viewed in a cross section, forms a disk, the plane of which extends perpendicular to the nozzle axis A.

The small-diameter end section 4 features an opening 4' with a width of approximately 3 mm on its free end. A sealing bead 19 extends on its outwardly facing wall.

Figure 8:
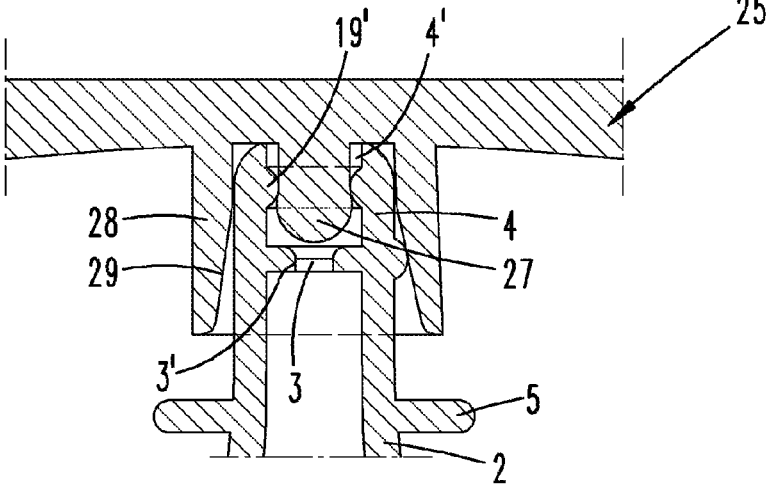
FIG. 8 shows the sealing elements 27, 28 and the small-diameter end section 4 according to a second exemplary embodiment.
Figure 9:
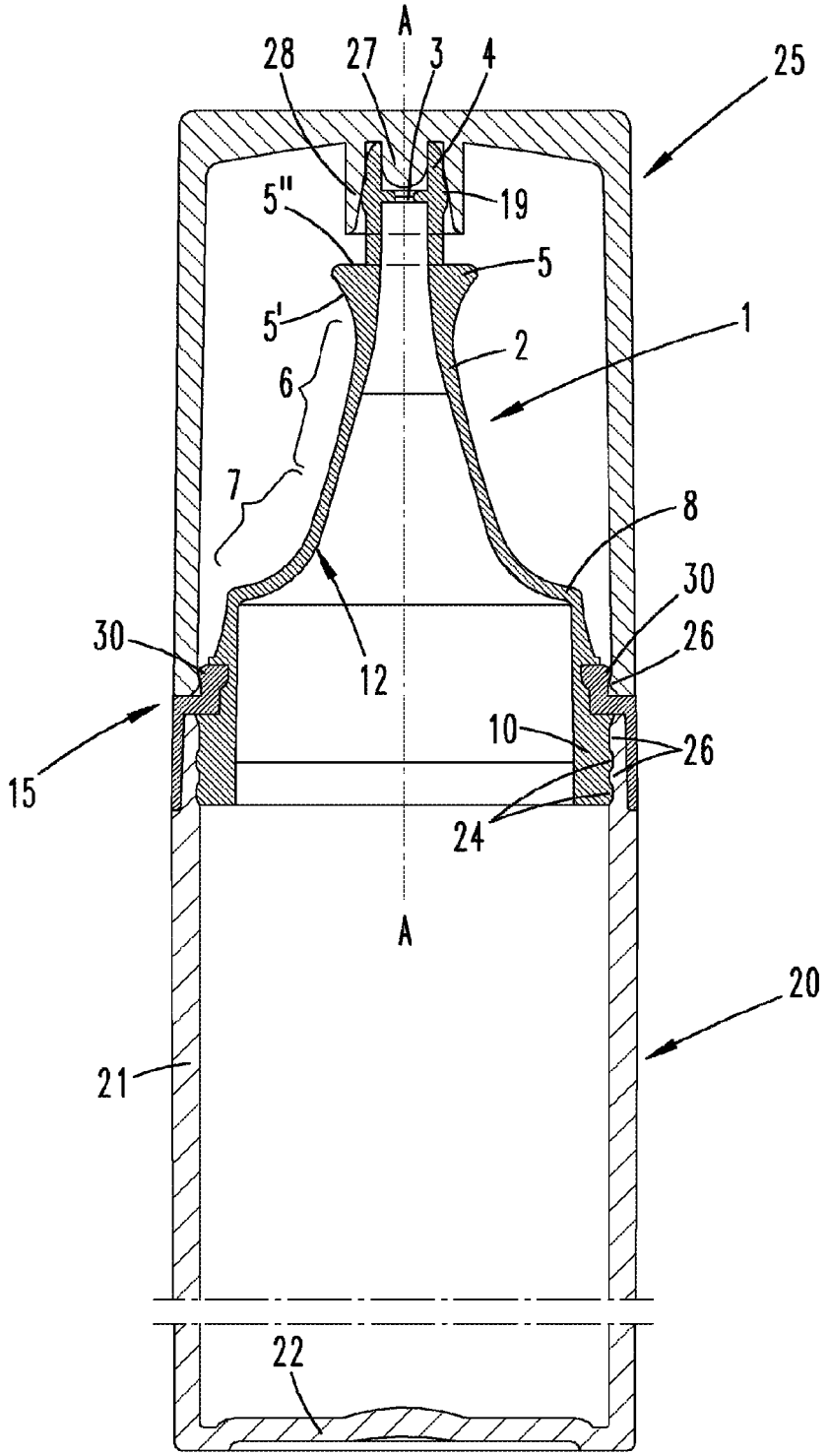
FIG. 9 shows a third exemplary embodiment in the form of an illustration according to FIG. 1.
Figure 10:
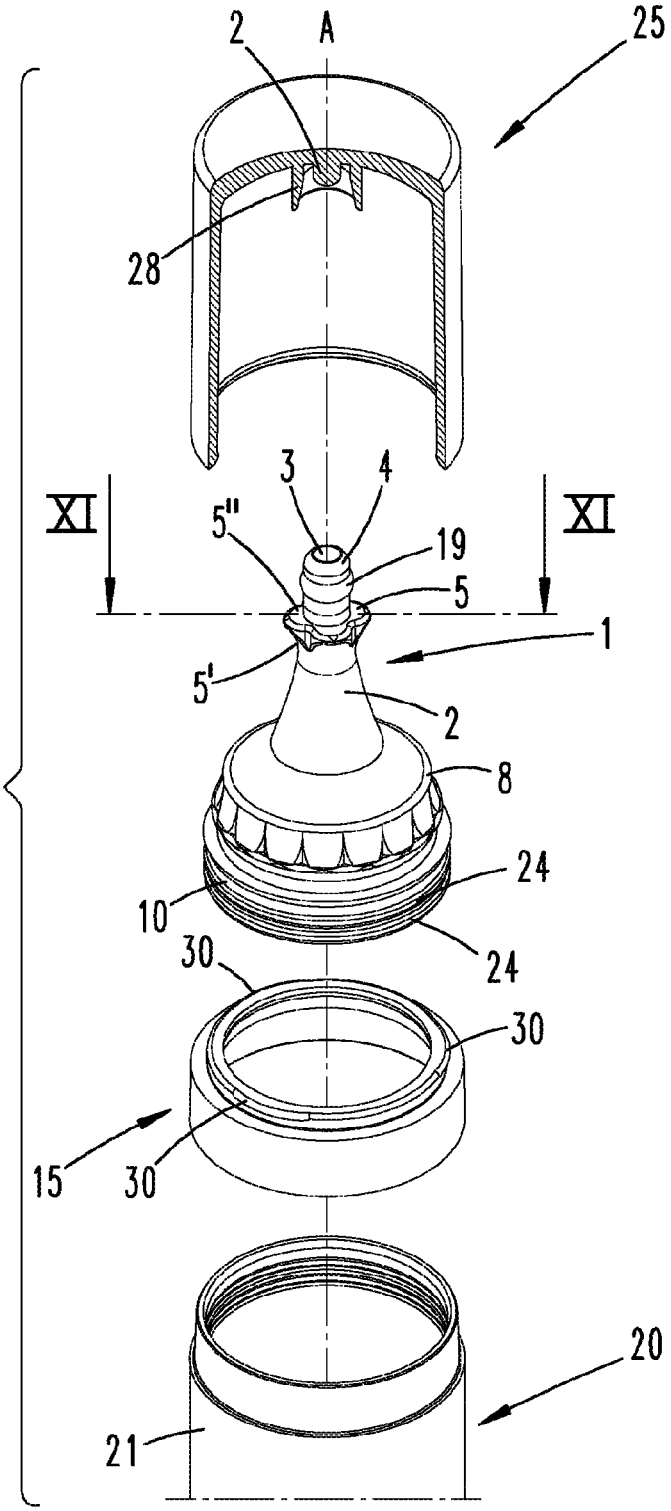
FIG. 10 shows an exploded view of essential components of the device illustrated in FIG. 9.

In the exemplary embodiment illustrated in FIG. 8, the sealing bead 19' extends along the inner wall of the opening 4' of the end section 4. The sealing projection 27 has an outside diameter that is slightly larger than the inside diameter enclosed by the sealing bead 19'. The outer surface area of the sealing projection 27 is a cylindrical surface that is in linear contact with an apex line of the sealing bead 19'.

An edge 3' surrounding a central outlet opening 3 extends within the nozzle 2 at a distance of approximately 3-5 mm from the outermost edge of the opening 4. The diameter of the outlet opening 3 may lie between 1 and 3 mm depending on the viscosity of the medium stored in the cup part 20.

The bottom of the cover 25 features a central sealing projection 27 that engages into the opening 4' when the cover 25 is attached onto the nozzle 2. In the exemplary embodiment illustrated in FIG. 8, the sealing bead 19' is in sealing contact with the sealing projection 27. In the exemplary embodiment illustrated in FIG. 1, the inner wall of the opening 4' is in sealing contact with the sealing projection 27.

The sealing projection 27 is enclosed by an annular projection 28 such that an annular groove remains between the sealing projection 27 and the annular projection 28. The end section 4 is inserted into this annular groove. The inner wall of the annular projection 28 may be inclined in a funnel-shaped fashion. In the exemplary embodiment illustrated in FIG. 1, the sealing bead 19 adjoins the inner wall of the annular projection 28 in a sealing fashion.

Figure 4:
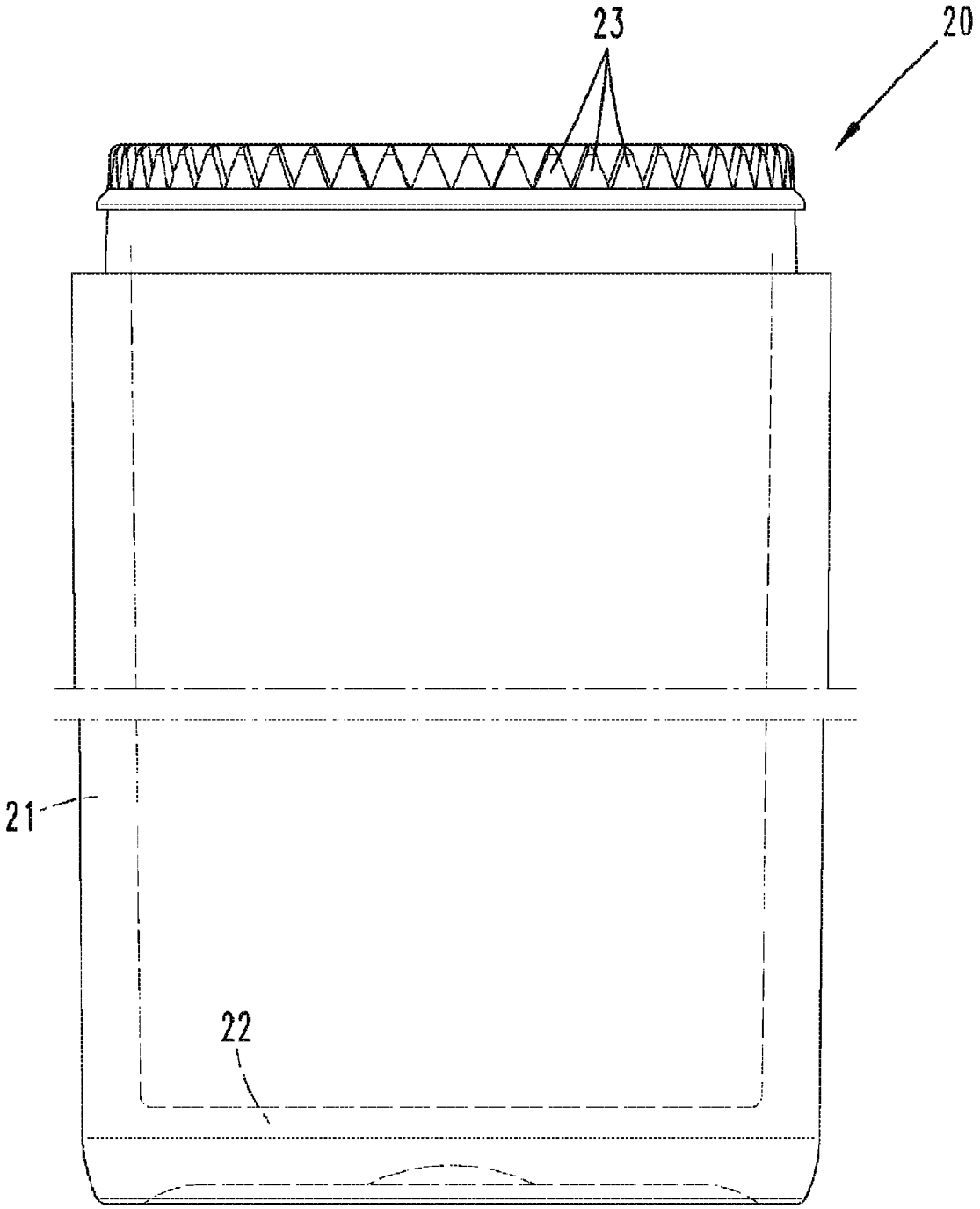
FIG. 4 shows the receptacle 20.
Figure 5:
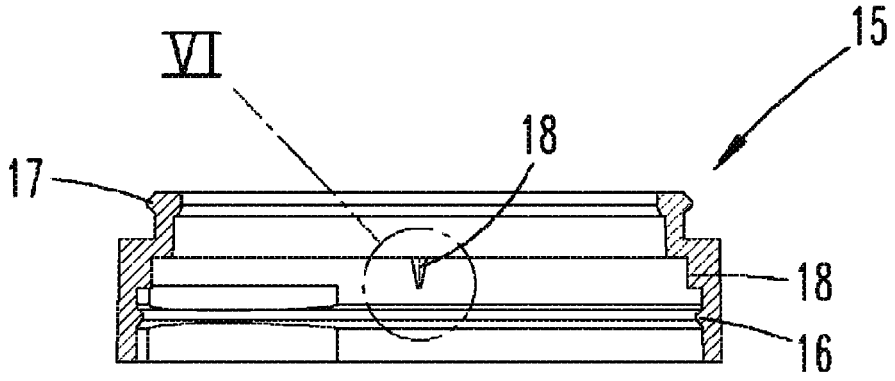
FIG. 5 shows a section through the mounting collar 15.
Figure 6:
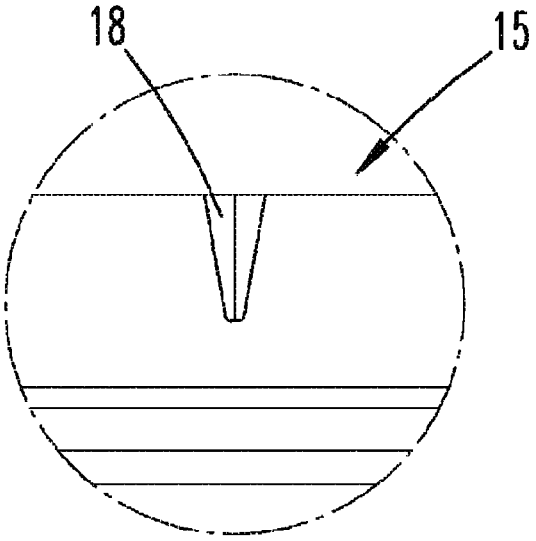
FIG. 6 shows the detail VI of FIG. 5.

The anti-rotation safety is illustrated in FIGS. 4-6. The outermost edge of the cup 20 features a toothing with gaps that form anti-rotation recesses 23. The mounting collar 15 features one or more anti-rotation projections 18 that respectively engage into an anti-rotation recess 23 when the mounting collar 15 is attached onto the edge of the cup part 20.

Figure 7:
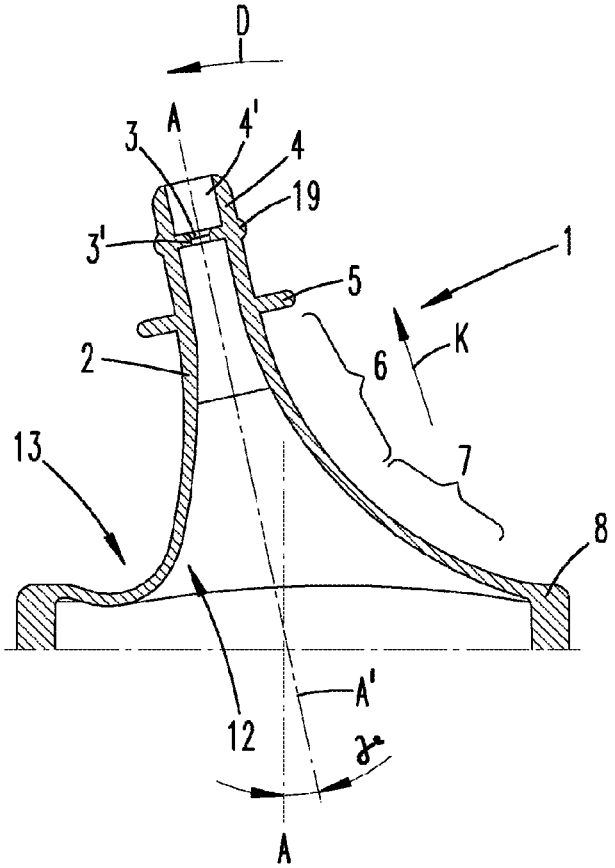
FIG. 7 shows an illustration of the nozzle 2 in the tilted state.

FIG. 7 shows the functionality of the nozzle 2. The nozzle axis A, which extends through the center of the opening 4' and the center of the opening of the cup part 20 and simultaneously represents the rotational symmetry axis of the entire device, extends perpendicular to a plane, in which the edge 8 of the large-diameter end section 10 lies.

A torque is exerted upon the nozzle 2 in the direction of the arrow D when a force K is exerted upon the actuating projection 5 in the direction of the arrow in FIG. 7, wherein the force K may also extend in the direction of the axis A. As a result, the nozzle axis A is inclined to a direction A' by an angle $\gamma$. A concavity 13 is formed in the region of the curved sections 6, 7 on the side lying opposite of the force application side simultaneously with this inclination or tilting of the nozzle 2. The curvature radius decreases in the transition area between the slightly curved section 6 and the sharply curved section 7 and a large area of the thin-wall nozzle wall section arches into the contour volume of the cap 1, which is not acted upon with a force. This reduces the inner volume of the cap such that the medium can escape from a device that has been turned upside down through the outlet opening 3. The amount dispensed can be influenced by the degree, to which the nozzle 2 is tilted.

The circumferential and rotationally symmetrical actuating projection 5 allows a simple operation. The finger exerting the force K required for tilting the nozzle is prevented from coming in contact with the liquid or pasty mass being discharged from the opening 4'. The fingertip finds a secure hold on the radially protruding actuating projection 5. The rotational position of the device is irrelevant due to its rotational symmetry.

However, the nozzle 2 may also feature an actuating zone with different haptic properties than the adjacent surface instead of an actuating projection 5. The actuating zone may consist of an annular zone around the entire circumference of the nozzle. This may concern a roughened surface section. However, the actuating zone may also be realized in the form of a nub arrangement.

In the exemplary embodiment, the connection between the cap 1 and the cup 20 is realized in the form of a plug-in connection. Alternatively, the connection between the cap 1 and the cup part 20 may also be realized in the form of a threaded connection. The cup may have a volume between 10 and 50 ml.

The material of the nozzle 2 has a sufficiently high elasticity for once again returning the nozzle 2 into its original position illustrated with broken lines after the force K has been suspended.

FIGS. 9-14 show a third exemplary embodiment of the invention, which essentially can be distinguished from the above-described exemplary embodiments by the design of an actuating zone 5 on the small-diameter end section of the slightly curved section 6 of the nozzle 2. The nozzle 2, which becomes more slender in the direction of the outlet opening 3, transforms into a fingertip contact surface 5'. The fingertip contact surface 5' forms an annular neck region, in which the diameter of the nozzle 2 increases. The fingertip contact surface 5' therefore forms a contact flank of a radially protruding actuating projection 5. In the exemplary embodiment, multiple actuating projections 5, particularly four actuating projections, are arranged in uniform circumferential distribution around the nozzle axis A and TO respectively feature a curved fingertip contact surface 5'. A surface facing away from the fingertip contact surface 5' forms a plane 5". This plane 5" points toward the edge of the outlet opening 3. All actuating projections 5 feature a flank that is directed toward the outlet opening 3, wherein all flanks lie in the plane 5". The plane 5" extends transverse to the nozzle axis A.

Figure 11:
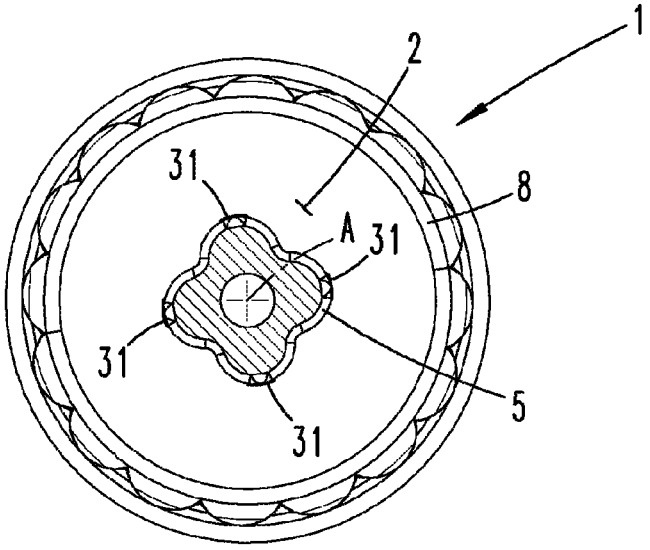
FIG. 11 shows a section along the line XI-XI in FIG. 10.
Figure 12:
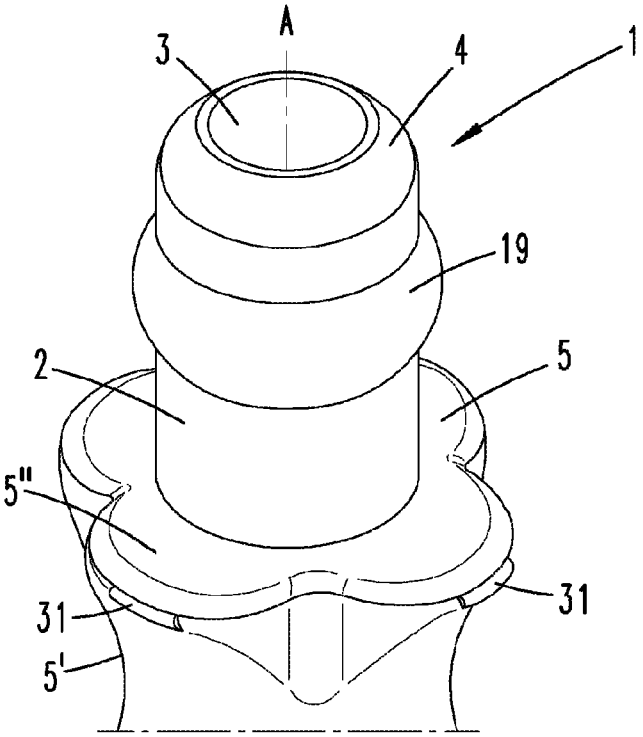
FIG. 12 shows an enlarged perspective view of the outlet opening 3 and the actuating projections 5.

According to FIGS. 11 and 12, the contour line of the plane 5" is composed of four semicircular arc sections that are connected to one another such that oppositely directed arc sections are formed. If viewed in a cross section, the individual actuating projections 5 therefore have a curved circumferential contour line.

The contour lines of the actuating projections 5 lying on the semicircular arc sections have an apex with a projection 31 that protrudes radially outward.

Figure 13:
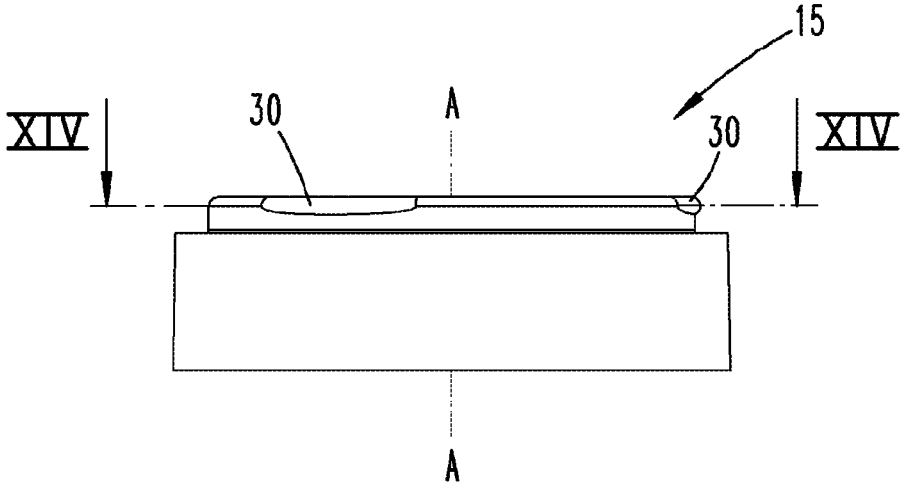
FIG. 13 shows a side view of the mounting collar 15.
Figure 14:
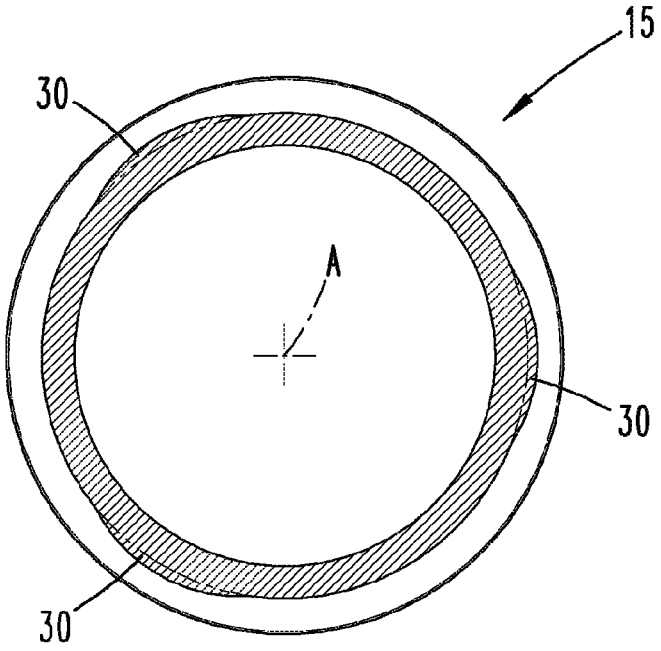
FIG. 14 shows a section along the line XIV-XIV in FIG. 13.

FIGS. 13 and 14 show a mounting collar 15 with projections 30 that are directed radially outward. A total of three projections 30 are arranged at an angular spacing of 120° from one another in order to thereby make it possible to seal the cover 25 similar to a bayonet coupling.

The material of the nozzle 2 forms snap-on projections 24 that protrude radially outward. The snap-on projections 24 adjoin the inner wall of the outer edge of the cup part 20, which for this purpose respectively feature mating projections 26 or grooves lying in between. An outer edge section of the cup part 20 therefore lies in an annular opening between an edge of the mounting collar 15 consisting of a harder plastic and a section of the nozzle 2 consisting of a softer plastic.

The preceding explanations serve for elucidating all inventions that are included in this application and respectively enhance the prior art independently with at least the following combinations of characteristics, namely:

A device, which is characterized in that the wall of the annular neck 7, 8 is so flexible that the axis A of the nozzle 2 is tilted by an angle γ and a concavity 13 is formed in the region of the annular neck 6, 7 when a force K is exerted upon the small-diameter end section 4.

A device, which is characterized in that an actuating zone 5 for exerting a force K is assigned to the small-diameter end section 4.

A device, which is characterized in that the actuating zone features at least one actuating projection 5 that protrudes, in particular, transverse to the nozzle axis A.

A device, which is characterized in that the at least one actuating projection 5 features a rounded fingertip contact surface 5 or is formed by a nub or a collar, particularly a collar with a circular horizontal projection, or in that the actuating zone 5 consists of a roughened surface section.

A device, which is characterized in that the annular neck 6, 7 features a sharply curved section 7, which is directly attached to an edge 8 of the large-diameter end section 10, as well as a slightly curved section 6, which follows the sharply curved section and borders on the actuating projection 5.

A device, which is characterized in that the wall thickness of the wall is smaller in the region of the annular neck 6, 7 than in the region of the two end sections 4, 10.

A device, which is characterized in that the nozzle 2 is realized in the form of a body of revolution around the nozzle axis A and made of a soft plastic, particularly of polypropylene.

A device, which is characterized in that the nozzle 2 is connected to a mounting collar 15 made of a hard plastic, particularly of polypropylene.

A device, which is characterized by an outlet opening 3 that is arranged within and has a smaller diameter than the opening 4', wherein said outlet opening is enclosed by an edge and spaced apart from the edge of the opening 4' of the end section 4 in the direction of the nozzle axis A.

A device, which is characterized by a cover 25 that features sealing means 27, 28, by means of which the opening 4' is sealed when the cover is attached onto the cap 1.

A device, which is characterized in that the cap 1 seals the opening of a cup part 20 and is non-rotationally connected to the cup part, wherein the nozzle 2 forms a sealing flank 11 that is adjoined by an edge section of the cup part 20 in a sealing fashion.

All disclosed characteristics are essential to the invention (individually, as well as in combined form.) The entire content disclosed in the associated/attached priority documents (copy of the priority application) is hereby incorporated into the disclosure of this application, namely also for the purpose of including characteristics of these documents in claims of the present application. The characteristics of the dependent claims define independent inventive enhancements of the prior art, in particular, in order to submit divisional applications on the basis of these claims.

LIST OF REFERENCE SYMBOLS

1 Cap
2 Nozzle
3 Outlet opening
3' Edge
4 End section
4' Opening
5 Actuating projection, annular projection, collar
5' Fingertip contact surface
5" Plane
6 Slightly curved section
7 Sharply curved section
8 Edge
10 End section
11 Sealing flank
12 Bending zone
13 Concavity
15 Mounting collar
16 Snap-on projection
17 Threaded rib
18 Anti-rotation projection
19 Sealing bead
19' Sealing bead
20 Cup part, cup
21 Sidewall
22 Bottom
23 Anti-rotation recess
24 Mating projection
25 Cover
26 Threaded rib
27 Sealing projection
28 Annular projection
29 Inclination
30 Radial projection 31 Projection
A Nozzle axis
A' Nozzle direction
D Arrow
K Force
γ Angle

The invention claimed is:

1. A device for dispensing drops with a cap that forms a nozzle, wherein the nozzle has a wall that is attached to a large-diameter end section and in certain areas is formed as an annular neck, and a small-diameter end section that is attached to the annular neck and features an opening, wherein an axis of the nozzle extends through the opening and the large-diameter end section, wherein the wall of the annular neck is so flexible that the axis of the nozzle is tilted by an angle and a concavity is formed in a region of the annular neck when a force is exerted upon the small-diameter end section.

2. The device according to claim 1, wherein an actuating zone for exerting a force is assigned to the small-diameter end section.

3. The device according to claim 1, wherein the wall has a wall thickness in a region of the annular neck that is smaller than in a region of the two end sections.

4. The device according to claim 1, wherein the nozzle is formed as a body of revolution around the nozzle axis and made of a soft plastic.

5. The device according to claim 4, wherein the soft plastic is polypropylene.

6. A device for dispensing drops with a cap that forms a nozzle, wherein the nozzle has a wall that is attached to a large-diameter end section and in certain areas is formed as an annular neck, and a small-diameter end section that is attached to the annular neck and features an opening, wherein an axis of the nozzle extends through the opening and the large-diameter end section, wherein the wall of the annular neck is so flexible that the axis of the nozzle is tilted by an angle and a concavity is formed in a region of the annular neck when a force is exerted upon the small-diameter end section, wherein an actuating zone for exerting a force is assigned to the small-diameter end section, wherein the actuating zone features at least one actuating projection that protrudes transverse to the nozzle axis.

7. The device according to claim 6, wherein the at least one actuating projection has a rounded fingertip contact surface or is formed by a nub or a collar or the actuating zone consists of a roughened surface section.

8. The device according to claim 7, wherein the collar has a circular horizontal projection.

9. The device according to claim 6, wherein the annular neck has a sharply curved section that is directly attached to an edge of the large-diameter end section, as well as a slightly curved section that follows the sharply curved section and borders on the actuating projection.

10. A device for dispensing drops with a cap that forms a nozzle, wherein the nozzle has a wall that is attached to a large-diameter end section and in certain areas is formed as an annular neck, and a small-diameter end section that is attached to the annular neck and features an opening, wherein an axis of the nozzle extends through the opening and the large-diameter end section, wherein the wall of the annular neck is so flexible that the axis of the nozzle is tilted by an angle and a concavity is formed in a region of the annular neck when a force is exerted upon the small-diameter end section, wherein the nozzle is connected to a mounting collar made of a hard plastic.

11. The device according to claim 10, wherein the hard plastic is polypropylene.

12. A device for dispensing drops with a cap that forms a nozzle, wherein the nozzle has a wall that is attached to a large-diameter end section and in certain areas is formed as an annular neck, and a small-diameter end section that is attached to the annular neck and features an opening, wherein an axis of the nozzle extends through the opening and the large-diameter end section, wherein the wall of the annular neck is so flexible that the axis of the nozzle is tilted by an angle and a concavity is formed in a region of the annular neck when a force is exerted upon the small-diameter end section, comprising an outlet opening arranged within the opening and having a smaller diameter than the opening, wherein said outlet opening is enclosed by an edge and spaced apart from the edge of the opening of the end section in a direction of the nozzle axis.

13. A device for dispensing drops with a cap that forms a nozzle, wherein the nozzle has a wall that is attached to a large-diameter end section and in certain areas is formed as an annular neck, and a small-diameter end section that is attached to the annular neck and features an opening, wherein an axis of the nozzle extends through the opening and the large-diameter end section, wherein the wall of the annular neck is so flexible that the axis of the nozzle is tilted by an angle and a concavity is formed in a region of the annular neck when a force is exerted upon the small-diameter end section, comprising a cover with a seal that seals the opening when the cover is attached onto the cap.

14. A device for dispensing drops with a cap that forms a nozzle, wherein the nozzle has a wall that is attached to a large-diameter end section and in certain areas is formed as an annular neck, and a small-diameter end section that is attached to the annular neck and features an opening, wherein an axis of the nozzle extends through the opening and the large-diameter end section, wherein the wall of the annular neck is so flexible that the axis of the nozzle is tilted by an angle and a concavity is formed in a region of the annular neck when a force is exerted upon the small-diameter end section, wherein the cap seals the opening of a cup part and is non-rotationally connected to the cup part, wherein the nozzle forms a sealing flank that is adjoined by an edge section of the cup part in a sealing fashion.

* * * * *